United States Patent [19]

Glerum et al.

[11] Patent Number: 4,742,949

[45] Date of Patent: May 10, 1988

[54] METHOD AND APPARATUS OF MANUFACTURING A BODY OF A CONTAINER, SAME BODY AND SAME CONTAINER

[75] Inventors: Johannes A. Glerum, Deventer; Hendrik G. Heyting, Epse, both of Netherlands

[73] Assignee: Thomassen & Drijver-Verblifa NV, Netherlands

[21] Appl. No.: 739,020

[22] Filed: May 29, 1985

[30] Foreign Application Priority Data

Jun. 8, 1984 [NL] Netherlands ..... 8401834

[51] Int. Cl.[4] ..... B21C 37/08

[52] U.S. Cl. ..... 228/156; 413/1; 72/347

[58] Field of Search ..... 72/51, 52, 283, 370, 72/391, 368, 348, 347; 228/150, 155, 156; 219/59.1, 61.11, 64; 413/1, 73, 77

[56] References Cited

U.S. PATENT DOCUMENTS

| | | | |
|---|---|---|---|
| 602,417 | 4/1898 | McCool | 72/283 |
| 616,357 | 12/1898 | Reynolds et al. | 72/283 |
| 682,423 | 9/1901 | Patterson | 228/150 |
| 1,362,457 | 12/1920 | Wilcox . | |
| 3,077,171 | 2/1963 | Gotsch et al. | 228/150 |
| 4,320,848 | 3/1982 | Dye et al. . | |

FOREIGN PATENT DOCUMENTS

| | | | |
|---|---|---|---|
| 0045115 | 2/1982 | European Pat. Off. . | |
| 410776 | 5/1947 | Italy | 72/368 |
| 0672272 | 5/1952 | United Kingdom . | |
| 2035856 | 6/1980 | United Kingdom . | |

*Primary Examiner*—Lowell A. Larson
*Attorney, Agent, or Firm*—John P. Snyder

[57] ABSTRACT

The invention relates to a method of manufacturing a body for a container, in which a body having a weldseam along its longitudinal direction is formed by bending material in sheet form and welding the overlapping edges of the bended material together, and the wall of the body having the longitudinal weldseam is thinned.

Preferably thinning is obtained by wall-ironing. It is advantageous that the wall thickness of a wall part close to wall end of the body is larger than that of a remaining part of the body and eventually prior to thinning has been reduced and that prior to being reduced the body is provided with a gripping rim and/or cover.

11 Claims, 3 Drawing Sheets

1
2
3
4
5
6
9
10
13

35
36

22
24
25
26
27

30
31
32
33
29
a
b
a
34

METHOD AND APPARATUS OF MANUFACTURING A BODY OF A CONTAINER, SAME BODY AND SAME CONTAINER

The invention relates to a method of manufacturing a body of a container, in which body with a longitudinal weldseam is formed by bending material in sheet form and welding together overlapping edges of the bended material.

Such a process is known. The manufactured body is used for the assembly of three-part containers made up of this body, a cover and a base. In the effort to reduce the material costs of such three-part containers, the wall thickness of, for example, the body is reduced until such a thin wall thickness has been achieved that the material can no longer be processed economically on welding equipment forming the longitudinal weldseam.

Container having a body which has an even further thinned wall thickness can be manufactured by using a disc shaped rondel which is subjected to a deep-drawing process followed by a wall-ironing process. There are a number of disadvantages arising from manufacture by wall-ironing of containers:

(a) there is little flexibility where body diameter is concerned, as a result of the preceding multiple deep-drawing operation whereby the body is stretched only along its longitudinal direction. If another diameter is required, another machine has to be used; and (b) the thickness of a base which forms an integral part of the body is inherently, generally the same as the thickness of the rondel used in the process. This means that an optimal wall thickness of the base cannot be chosen independently of the optimal wall thickness of the body. The use of a thicker base is to be recommended, for example, if the base is hollow and/or profiled and the container's contents are to come under considerable pressure.

Although wall-ironing is the preferred method for thinning of the body wall thickness, other techniques can also be applied, such as rolling, flattening, hammering and the like. Although it is not limited to this method, the invention will be described on the basis of the wall-ironing operation.

The invention has for its object the manufacturing of a body for a container in which as much as possible the advantages of the container consisting of three-parts and of containers obtained from wall-ironing are preserved.

In accordance with the invention this is achieved in that in the recited method the longitudinal weldseam is thinned.

It appears, surprisingly that the wall of welded bodies, including its weldseam, can be wall-ironed to a wall thickness which is generally uniform over its circumferential direction.

The method according to the invention provides a number of advantages, viz:

1. the container built up from three-parts has a wall-ironed wall, and the wall thickness of the body can be chosen independently of the wall thickness of the base and/or the cover;

2. greater flexibility is allowed where diameter and height are concerned, because, in order to arrive at a greater diameter, a greater width of material in sheet form is used or, alternatively, thicker sheet material which is subjected to a greater extent to a wall-ironing operation;

3. a large extent of independence in the choice of sheet material thickness to be used, because of an erratic price movement, between costs of the material in plate form and its thickness;

4. the wall-ironing process produces a shiny body surface free of a weldseam, which has a greater consumer attraction potential after decoration;

5. possible imperfections in the weldseam are smoothed out during the wall-ironing process;

6. there is no step wise change at the weldseam on the interior surface of the body, with the result that conditions are virtually ideal for the coating of the body's interior with protective varnishes and the like; and 7. there is no risk that, during the fold seaming of a base and/or cover onto the body, an irregular weldseam will result in the seam joint which is not completely closed.

If the body is wall-ironed as such that the wall thickness of the wall-ironed body varies along its longitudinal length, in which preferably the wall thickness of an end wall part of the thinned body is thicker than the thickness of the remaining part of the thinned body, a wall-ironed body results which has at least one thicker end wall portion, so that when a cover and/or base is attached by fold seaming, no breakage occurs in the fold seamed body wall.

In order to avoid, during wall-ironing using a wall-ironing mandril, any relative movement occuring between, on the one side, the welded body to be wall-ironed and, on the other, the wall-ironing mandril, it is preferable that, prior to wall-ironing, the body is provided with a gripping rim and/or cover.

Another aspect of the invention relates to a body manufatured in accordance with the process and a container having such a body.

Finally the invention relates to an apparatus for manufacturing a body for a container, comprising a bending unit and a welding unit, which is characterized by a thinning unit in the course of the manufacturing process nextfollowing the welding unit.

Mentioned and other characteristics will be made clear on the basis of a number of non-limitative embodiments, given by way of illustration, and with reference to the annexed drawings.

Figure 10:
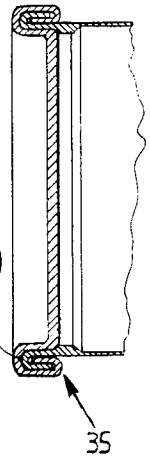
Figure 8:
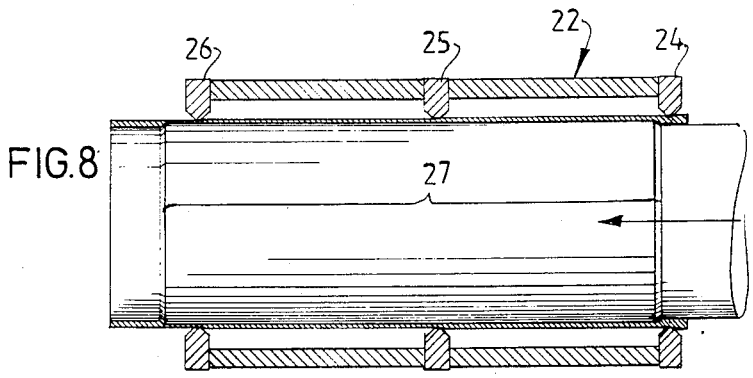
Figure 9:
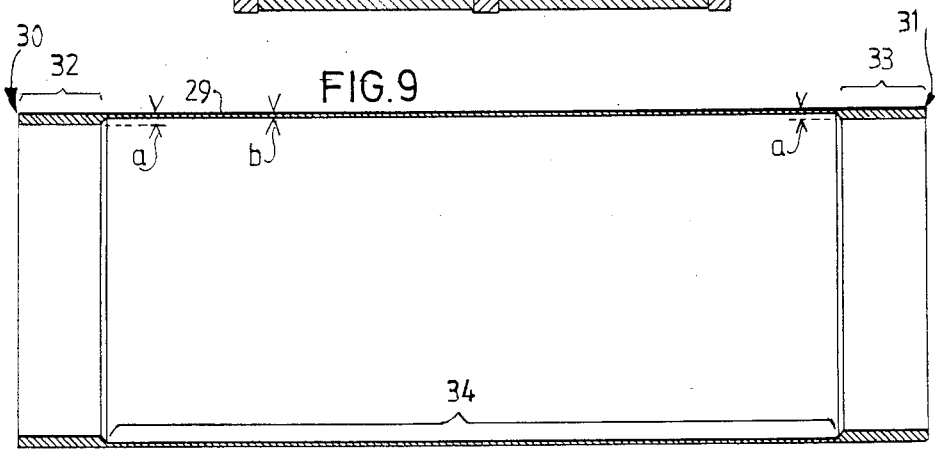
Figure 4:
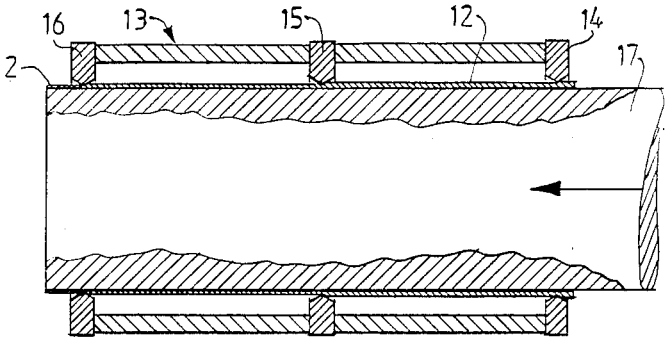
FIG. 4 shows a schematic section of the wall-ironing of the body shown in FIG. 3.
Figure 6:
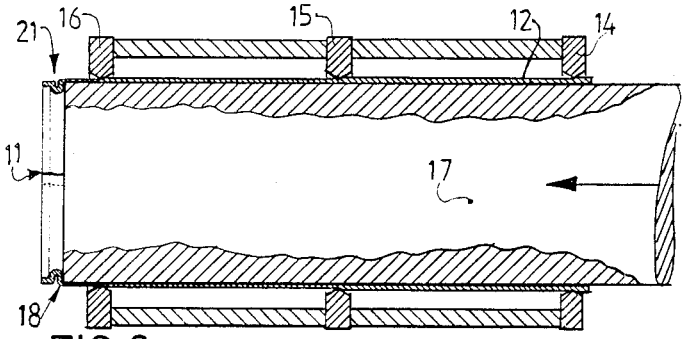
Figure 7:
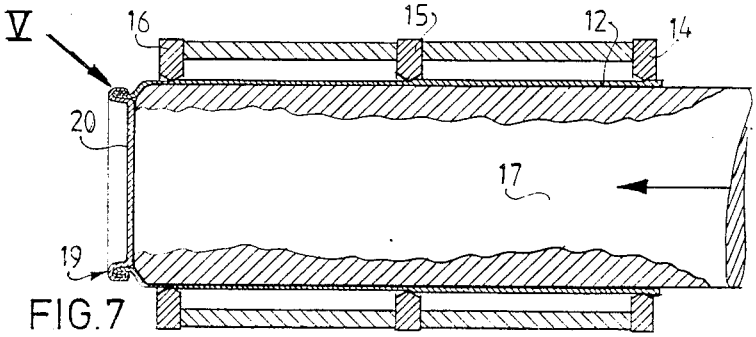
Figures 11, 12, 13:
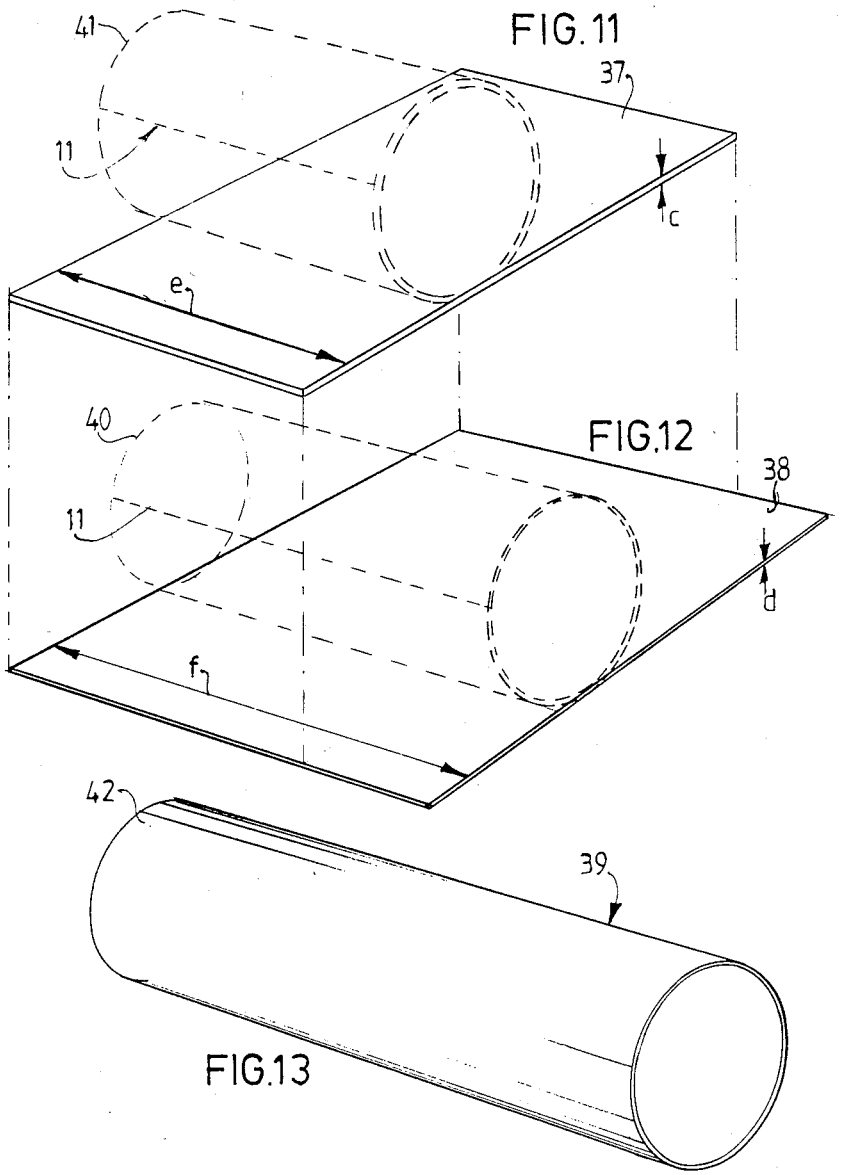

FIGS. 6 and 7 each show a variant of the process shown in FIG. 4, where, prior to wall-ironing, the body is provided with a gripping rim and seamed cover, respectively;

FIG. 8 shows the wall-ironing according to the invention, of a welded body into a wall-ironed body with variable wall thickness;

FIG. 9 shows on a larger scale a body manufactured according to the process shown in FIG. 8;

FIG. 10 shows detail X from FIG. 7;

FIGS. 11 and 12 are schematic illustrations of the manufacture of a welded body that is to be wall-ironed, starting from various materials in sheet form; and FIG. 13 gives a perspective view of a welded, wall-ironed body, produced from the welded body as in FIG. 11 or 12.

Figure 1:
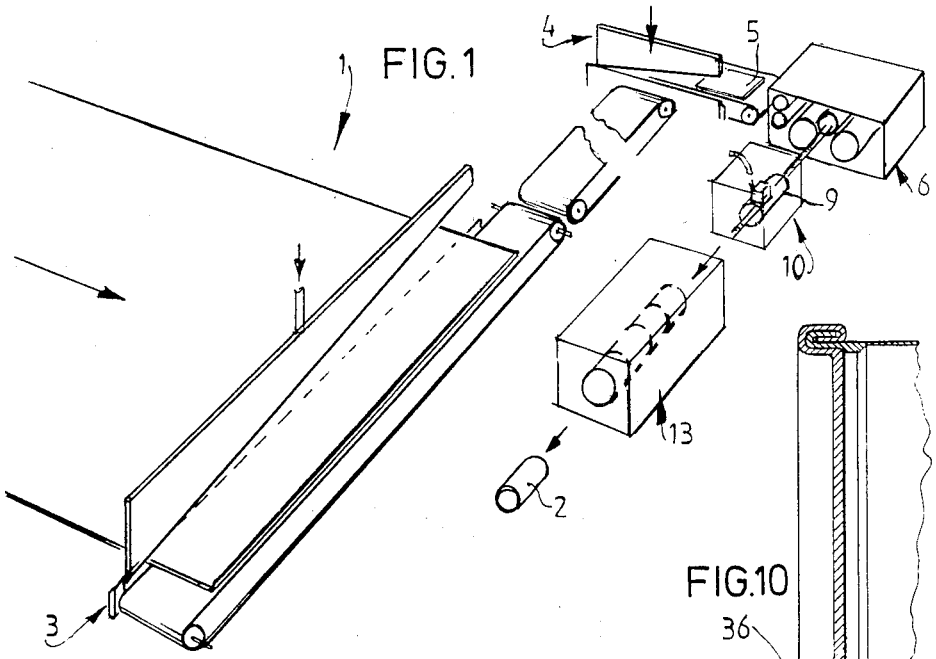
FIG. 1 shows an apparatus according to the invention, for the manufacture of a wall-ironed body for a container having a weldseam.

FIG. 1 shows an apparatus 1 of manufacturing a wall-ironed body 2 in accordance with the invention. The apparatus comprises cutting means 3 and 4 for the production of a piece of material in sheet form, which is bent in the bending unit 6. During the subsequent manufacturing process the overlapping edges 7 and 8 of the bent material 9 are welded together in the welding unit 10.

Figure 2:
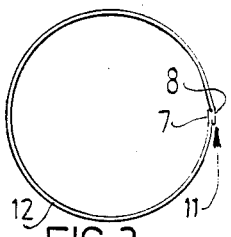
FIG. 2 is a front view of a welded body that is to be wall-ironed.
Figure 3:
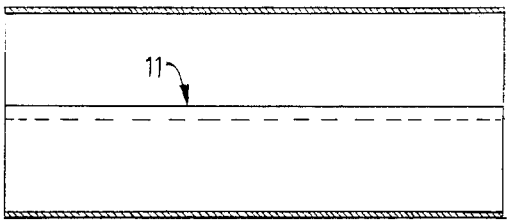
FIG. 3 is a longitudinal section of the body to be wall-ironed shown in FIG. 2.

After the welding unit 10, the bended body 12 having a weldseam 11 is wall-ironed in the wall-ironing unit 13. (see FIGS. 1, 2 and 3).

Figure 5:
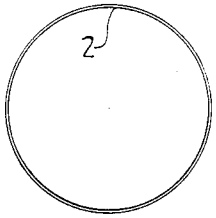
FIG. 5 shows a front view of the product of the process illustrated in FIG. 4.

FIG. 4 shows in more detail the wall-ironing unit 13, which comprises three wall-ironing rings 14, 15 and 16, and a wall-ironing mandril 17 which can be moved therethrough. The body to be wall-ironed 12 is placed on the wall-ironing mandril 17. In FIG. 4 the wall-ironing mandril 17 with the body 12 placed there on are moved through the wall-ironing rings 14, 15 and 16 as such that, while the body 13 is well clamped onto the wall-ironing mandril 17, no relative movement occurs between the wall-ironing mandril 17 and the end wall portion of the body 12 during the wall-ironing operation. The result of the wall-ironing process shown in FIG. 4 is illustrated in FIG. 5. In contrast to FIG. 2 a wall-ironed body 2 has been produced with a smaller wall thickness, while the weldseam 11 originally present is no longer or virtually not visible. This results in a wall-ironed body 2 with a flawless and virtually smooth interior and exterior surfaces.

If it should be assured that no relative movement should occur between a body to be wall-ironed 12 and the wall-ironing mandril 17, it is worth recommending that, prior to the wall-ironing of the body 12, it is fitted with a gripping rim 18 (see FIG. 6), or that, using a fold seam joint 19, a cover 20 is mounted onto it.

Because the gripping rim is mounted prior to the wall-ironing, one wall section 21 will show residual traces of the original weldseam 11.

In order to mount the gripping rim 18 and/or the cover 20, a device not shown has to be included in the apparatus 1 shown in FIG. 1 between the welding unit 10 and the wall-ironing unit 13, for mounting a gripping rim 18 or a cover 20 onto the body 12 to be wall-ironed.

FIG. 8 illustrates another wall-ironing unit 22 with three wall-ironing rings 24–26 and a wall-ironing mandril 23. The wall-ironing mandril 23 has a part 27 with a greater diameter, so that using the wall-ironing unit 22, a wall-ironed body can be produced, out of a body 28 having a weldseam, which has a wall thickness varying along its longitudinal length (as illustrated on a larger scale in FIG. 9). The process for the manufacture of bodies with variable wall thickness made by wall-ironing is described in, for example, the European patent specification No. 0 045 115 in the name of Thomassen & Drijver-Verblifa N.V., Deventer, the Netherlands.

FIG. 9 shows clearly that the wall ends 32 and 33 situated close to the end wall portions 30 and 31 have a wall thickness a which is larger than the wall thickness b of a remaining part 34 of the wall-ironing process, a weldseam is not or virtually not visible, on either the interior or the exterior surface of the wall section 32. This in contrast to the body 12, where residual traces of the weldseam 11 remain visible on the wall part 21 (see FIG. 6). The larger thickness a is advantageous because, in forming a fold seam joint, this greater thickness considerably reduces the occurrence of breakage at the bended section 36.

FIGS. 11 and 12 illustrate the great degree of flexibility resulting from the method used in accordance with the invention. Starting from material in sheet form 37 with a thickness c or from material in sheet form with a thickness d which is less than the thickness c, a similar wall-ironed body 39 can be formed, originally having a weldseam. The reduction of thickness c to thickness d is the result of a predetermined proportional increase of the width e of the sheet material 37 to the width f of the sheet material 38.

The bended bodies 40 and 41 having a weldseam 11 and are to be wall-ironed originate from the materials in sheet form 37 and 38 and are both shown in dashed lines. The thickness a is for example equal to 0.3 mm and the thickness b to 0.1 mm. In addition, sheet material of a standard composition is used, as well as the usual material for forming the weldseam, which has a composition known in the art.

As FIG. 13 clearly shows, the outer surface 42 of the wall-ironed body 39, originally comprising a weldsam, is rather flat and smooth. This will lead to good results for the decoration of the external surface.

In the invention, all known materials used in the manufature of a container can be used, such as tinplate, cold rolled steel, aluminium and the like.

In calculating the length of a sheet to cut dependent upon its thickness, a simple geometric relation is followed. For example, since the width W will be the same for sheets having different starting thicknesses T and T′ (the starting internal diameter being the same for the welded bodies) and corresponding different starting lengths l and l′, a simple area relationship prevails. That is, if the finished length of the body is L with a finished thickness t in each case, the $Lt = lT = l'T'$. Since the product Lt will be known as will the two thicknesses T and T′, it is a simple matter to compute the lengths l and l′.

We claim:

1. The method of making thin wall tubular container body members each having a length L with cover and base portions at their opposite ends and a main body portion joining the cover and base portions having a length l, a wall thickness t and a desired inner diameter d, which comprises the steps of:

(a) cutting sheet metal of thickness T where T is greater than t to provide a sheet metal blank having the thickness T and a length l′ which is less than L;

(b) bending the blank transversely into cylindrical form to present an unjoined seam extending longitudinally thereof;

(c) welding the unjoined seam to form a cylindrical blank having the length l′, an inner diameter about equal to d, a wall thickness T and a longitudinally extending weld seam which protrudes from the inner and outer surfaces of the cylindrical blank;

(d) fitting the cylindrical blank onto a mandril having a free end portion, a total length of at least L, an outer diameter not greater than d and a longitudinally extending portion which is of the length l and of uniform outer diameter d so that at least a portion of the cylindrical blank which is to become the main body portion of the tubular member extends in the direction from the free end portion of the mandril into overlapping, surrounding relation to the longtiduinally extending portion of the mandril; and (e) compressing the wall of the cylindrical blank against the outer surface of the mandril with force sufficient to elongate the length of the cylindrical blank axially from the free end portion of the mandril so that that portion of the cylindrical blank which is to become the main body portion of the tubular member completely surrounds the longitudinally extending portion of the mandril and is reduced in wall thickness therethroughout to the value t while imparting the inner diameter d and smooth inner and outer surfaces thereto.

2. The method as defined in claim 1 including the step, prior to step (d), of modifying the cylindrical blank by affixing an end closure member to one end thereof and, in step (d), abutting the end closure member against the free end of the mandril.

3. The method as defined in claim 2 wherein step (e) is effected by wall-ironing.

4. The method as defined in claim 1 wherein, in step (d), the cylindrical blank is elongated to the length L with a uniform outer diameter and the opposite end portions thereof having inner diameters less than d.

5. The method as defined in claim 4 wherein step (e) is effected by wall-ironing.

6. The method as defined in claim 1 wherein step (e) is effected by wall-ironing.

7. The method of making thin wall tubular container body members each having a length L with cover and base portions at their opposite ends and a main body portion joining the cover and base portions having a length l, a wall thickness t of about 0.1 mm and a desired inner diameter d, which comprises the steps of:

(a) cutting different sheet metal blanks from different sheet metal supplies having different thicknesses T where T is greater than t, having the same width W and different lengths l′ less than L;

(b) bending the different sheet metal blanks transversely into cylindrical form to present an unjoined seam extending longitudinally thereof;

(c) welding the unjoined seams of the different sheet metal blanks to form different cylindrical blanks having the different lengths l′, an inner diameter about equal to d as dictated by the same widths W of the different sheet metal blanks, the different wall thicknesses T; and (d) elongating the different cylindrical blanks each to the length L and while thinning the wall thicknesses of the tubular members in the main body portions of the tubular members to the thickness t.

8. The method as defined in claim 7 wherein step (d) is effected by wall-ironing.

9. The method of making thin wall tubular container body members of substantially identical dimensions from sheet metal stocks having different thicknesses, which comprises the steps of:

(a) cutting sheet metal blanks from a selected sheet metal stock having a thickness T, and wherein the sheet metal blanks have a standard width W and a selected length l′;

(b) bending the sheet metal blanks transversely into cylindrical forms to present unjoined seams extending longitudinally thereof;

(c) welding the unjoined seams to form cylindrical blanks having the lengths l′ and wall thicknesses T, a substantially standard inner diameter as dictated by the standard width W and a longitudinally extending weld seam which protrudes from the inner and outer surfaces of the cylindrical blanks;

(d) forming tubular container body members by thinning the wall thicknesses thereof to elongate the cylindrical blanks; and (e) controlling the selected length l′ of step (a) in accord with the thickness T of the selected metal stock so that step (d) produces tubular container bodies of said substantially identical dimensions.

10. The method as defined in claim 9 wherein step (d) is effected by wall-ironing.

11. The method as defined in claim 10 wherein the wall thicknesses are thinned in step (d) to about 0.1 mm.

* * * * *